US011534658B2

(12) United States Patent
Tseng

(10) Patent No.: US 11,534,658 B2
(45) Date of Patent: Dec. 27, 2022

(54) EXERCISE BIKE CONFIGURED TO FOLD AND CHANGE AT MULTIPLE ANGLES

(71) Applicants: Xiamen DMaster Health Tech Co., Ltd., Fujian (CN); Ching Tseng, Taiwan (CN)

(72) Inventor: Ching Tseng, Taiwan (CN)

(73) Assignee: Xiamen DMaster Health Tech Co., Ltd., Xiamen (CN)

( * ) Notice: Subject to any disclaimer, the term of this patent is extended or adjusted under 35 U.S.C. 154(b) by 0 days.

(21) Appl. No.: 17/380,072

(22) Filed: Jul. 20, 2021

(65) Prior Publication Data

US 2022/0023711 A1 Jan. 27, 2022

(30) Foreign Application Priority Data

Jul. 21, 2020 (CN) ..... 202021449947.8

(51) Int. Cl.
*A63B 22/06* (2006.01)

(52) U.S. Cl.
CPC ..... *A63B 22/0605* (2013.01); *A63B 22/0694* (2013.01); *A63B 2208/0233* (2013.01); *A63B 2225/09* (2013.01)

(58) Field of Classification Search
CPC ..... A63B 22/0046; A63B 22/0605; A63B 22/001; A63B 21/00178; A63B 21/0058; A63B 22/0005; A63B 21/00181; A63B 22/0012; A63B 2225/50; A63B 2225/09; A63B 2071/0694; A63B 2208/0242; A63B 71/0619; A63B 2225/093; A63B 2208/0228; A63B 2208/0247; A63B 2208/0233; A61H 1/0274; A61H 1/0277; A61H 1/0214; A61H 1/0281; A61H 1/0237; A61H 2201/5043; A61H 2201/0192; A61H 2203/0431; A61H 2201/1215; A61H 2201/1635; A61H 205/06; A61H 2203/0425; A61H 2203/0443; A61H 2201/1261; A61H 2201/50; A61H 2201/164; A61H 2201/1671; A61H 2203/045; A61H 2205/10

See application file for complete search history.

(56) References Cited

U.S. PATENT DOCUMENTS 1,820,372 A * 8/1931 Blomquist ..... A63B 22/001 482/62
4,369,966 A * 1/1983 Silberman ..... A63B 23/0211 482/145

(Continued)

FOREIGN PATENT DOCUMENTS

TW 200920444 A * 5/2009 ..... A63B 22/12

*Primary Examiner* — Andrew S Lo
*Assistant Examiner* — Andrew M Kobylarz
(74) *Attorney, Agent, or Firm* — Cooper Legal Group, LLC

(57) ABSTRACT

The present disclosure discloses an exercise bike capable of folding and changing at multiple angles. The exercise bike includes a base unit, a stand unit pivotally connected to a front end of the base unit, and a first resistance unit and a second resistance unit arranged on the stand unit and suitable for providing resistance for limbs when moving. The stand unit includes a lower riser that rotates in a first angle range relative to the base unit, and an upper riser that rotates in a second angle range relative to the lower riser.

17 Claims, 11 Drawing Sheets

(56) References Cited

U.S. PATENT DOCUMENTS

| | | | | |
|---|---|---|---|---|
| 4,521,012 | A * | 6/1985 | Cosby | A63B 22/0005 482/8 |
| 5,989,162 | A * | 11/1999 | Daniels | A63B 22/0694 482/62 |
| 10,143,875 | B2 * | 12/2018 | Moschel | A63B 21/4031 |
| 2006/0058163 | A1 * | 3/2006 | Matsumoto | A63B 22/0605 482/57 |
| 2012/0238411 | A1 * | 9/2012 | McBride | A63B 22/0005 482/57 |
| 2017/0105523 | A1 * | 4/2017 | McBride | A63B 22/0605 |
| 2018/0228682 | A1 * | 8/2018 | Bayerlein | A63B 21/00181 |
| 2019/0001186 | A1 * | 1/2019 | Esposito | A63B 23/12 |
| 2019/0054345 | A1 * | 2/2019 | Hsu | A63B 22/0605 |
| 2019/0070453 | A1 * | 3/2019 | Kiani | A63B 22/208 |
| 2020/0353310 | A1 * | 11/2020 | Bissonnette | A63B 22/0005 |
| 2020/0368574 | A1 * | 11/2020 | Bissonnette | A63B 21/4035 |
| 2021/0022941 | A1 * | 1/2021 | Reck | A63B 22/0046 |
| 2022/0023711 | A1 * | 1/2022 | Tseng | A63B 22/0005 |

* cited by examiner

EXERCISE BIKE CONFIGURED TO FOLD AND CHANGE AT MULTIPLE ANGLES

RELATED APPLICATION

The instant application claims priority to Chinese Patent Application 202021449947.8, filed Jul. 21, 2020, which is incorporated herein by reference.

TECHNICAL FIELD

The present disclosure relates to an exercise bike, and in particular, to an exercise bike capable of folding and changing at multiple angles suitable for the movement of limbs such as hands and feet.

BACKGROUND

Referring to FIG. 1, it is a prior art hand-foot exercise bike 1, including a base 11; a foot resistance unit 12 arranged on the base 11 and suitable for providing resistance to the moving feet; a stand 13 at an angle with the base 11; and a hand resistance unit 14 arranged on the stand 13 and suitable for providing resistance to the moving hands.

Since the foot resistance unit 12 is blocked between the stand 13 and the base 11, the stand 13 cannot be folded apart from the angle adjustment, so that the relative position of the foot resistance unit 12 with the hand resistance unit 14 is fixed and does not change. Users of different body shapes or different usage habits cannot operate the foot resistance unit 12 and the hand resistance unit 14 in the most appropriate posture. There are disadvantages existing in space occupation and the use limitation.

SUMMARY

To this end, the object of the present disclosure is to provide an exercise bike capable of folding and changing at multiple angles that can have a variety of usage patterns and can effectively improve space efficiency.

Therefore, the exercise bike configured to fold and change at multiple angles of the present disclosure includes a base unit, a stand unit, a first resistance unit, and a second resistance unit;

the base unit extending along a length direction and having a front end and a rear end in opposite directions;

the stand unit comprising a lower riser pivotally connected to the front end of the base unit, and an upper riser connected to the lower riser, wherein: the lower riser is configured to rotate relative to the base unit within a first angle range, the upper riser is configured to rotate relative to the lower riser within a second angle range;

the first resistance unit being provided on the lower riser of the stand unit and being configured to provide resistance to limbs when moving, and the second resistance unit being provided on the upper riser of the stand unit and being configured to provide resistance to limbs when moving.

The effect of the present disclosure is that through different angle changes of the upper riser and the lower riser, a variety of usage patterns can be transformed. When the stand unit rotates to 0 degrees relative to the base unit, and when the upper riser rotates to 0 degrees relative to the lower riser, the base unit, the upper riser and the lower riser are overlapped up and down, and the first resistance unit and the second resistance unit are spaced back and forth, such that the space occupied can be greatly reduced by the whole, and the space efficiency can be effectively improved.

DESCRIPTION OF EMBODIMENTS

Figure 1:
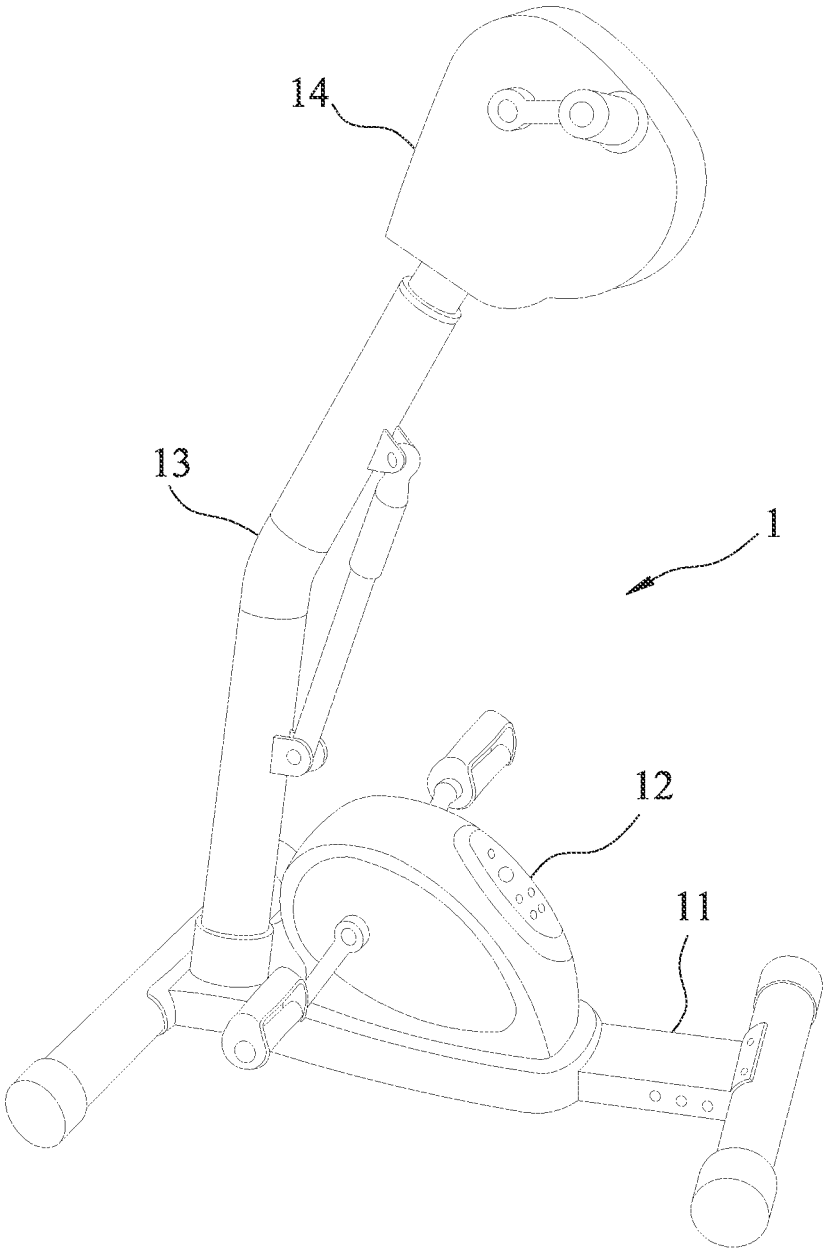
FIG. 1 Prior Art
FIG. 1 is a perspective view illustrating a hand-foot exercise bike in prior art.

To further illustrate the various embodiments, the present disclosure is provided with drawings. The drawings are a part of the present disclosure, which are mainly used to illustrate the embodiments, and can cooperate with the relevant description in the specification to explain the operation principle of the embodiments. With reference to these contents, those of ordinary skill in the art should be able to understand other possible implementation manners and advantages of the present disclosure. The components in the figures are not drawn to scale, and similar component references are usually used to indicate similar components.

The present disclosure will now be further described with reference to the drawings and specific embodiments.

Referring to FIGS. 2 to 6, an embodiment of the exercise bike capable of folding and changing at multiple angles in the present disclosure may include a base unit 2, a stand unit 3, a support unit 4, a first resistance unit 5, a second resistance unit 6, and a panel 7.

The base unit 2 may include a base 21 and two rollers 22.

The base 21 may extend along a length direction X and may have a front end 211 and a rear end 212 opposite to each other. The front end 211 may be provided with two connection lugs 213 extending along a height direction Z and spaced apart along a width direction Y. The rear end 212 may be provided with a handle 214 that can be held.

The two rollers 22 are pivoted on the bottom of the front end 211 of the base 21.

The stand unit 3 may extend along the height direction Z and may include a lower riser 31, an upper riser 32, a toggle member 33, a positioning bolt 34, a limit bolt 35, and an elastic element 36.

The lower riser 31 may be pivotally connected to the two connection lugs 213 with a first pivot point A1 as the center of rotation, and can rotate relative to the base 21 within a first angular range θ1, and the lower riser 31 may be also provided with a limit hole 311 at the upper end in the height direction Z. The first angle range θ1 may be between 0 degrees and 150 degrees, preferably, between 0 degrees and 95 degrees, and more preferably, between 0 degrees and 75 degrees.

The upper riser 32 can rotate relative to the lower riser 31 within a second angular range θ2, the second angular range θ2 may be between 0 degrees and 270 degrees, preferably, between 0 degrees and 180 degrees. The length of the upper riser 32 along the height direction Z may be less than the length of the lower riser 31 along the height direction Z.

Figure 3:
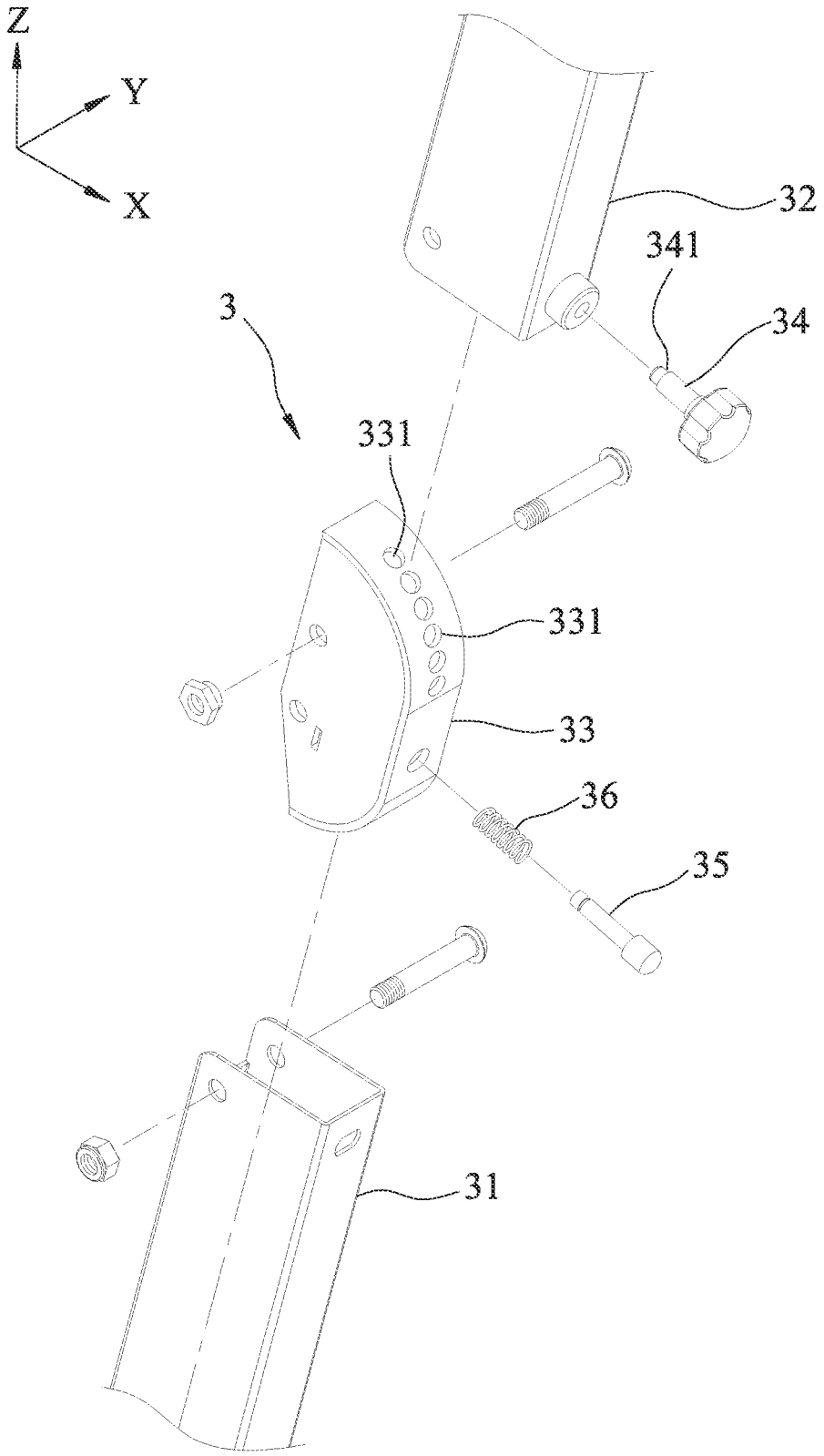
FIG. 3 is a partial three-dimensional exploded view illustrating a stand unit in the present embodiment.
Figure 4:
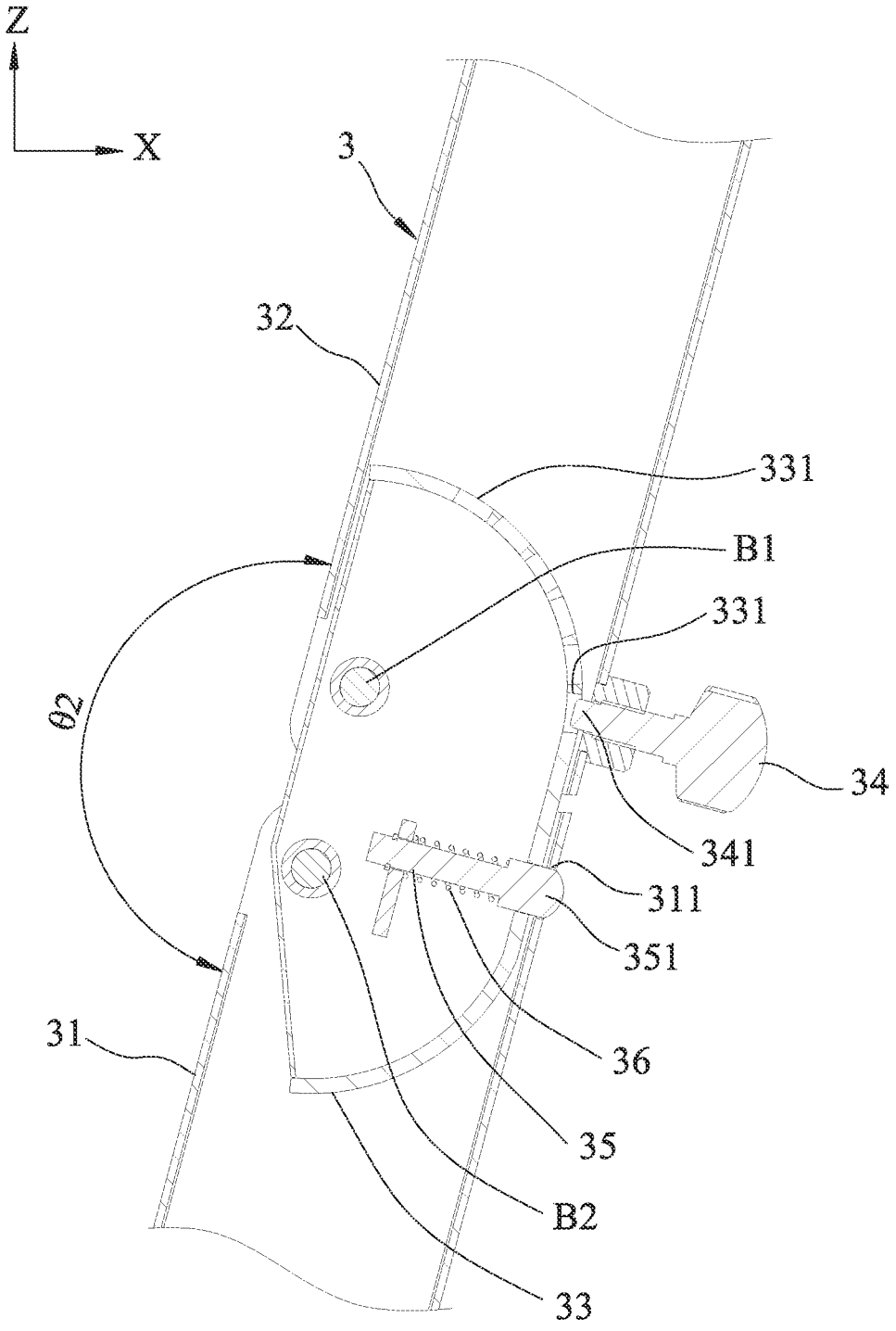
FIG. 4 is a partial cross-sectional view illustrating the stand unit in the present embodiment.

Referring to FIGS. 3 and 4, the toggle member 33 may be inserted between the upper riser 32 and the lower riser 31, and may be pivotally connected to the upper riser 32 with a first elbow joint B1, and may be pivotally connected to the lower riser 31 with a second elbow joint B2. The toggle member 33 may have a plurality of positioning holes 331 equiangularly distributed within a range of 90 degrees.

The positioning bolt 34 may be displaceably provided on the upper riser 32 relative to the toggle member 33 and may have a lock part 341 detachably inserted into any positioning hole 331. When the lock part 341 is inserted into the corresponding positioning hole 331, the upper riser 32 may be limited by the positioning bolt 34 and cannot rotate relative to the toggle member 33. It should be noted that the positioning bolt 34 may be a bolt independent from the upper riser 32, or a bolt coupled to the upper riser 32 with an elastic element (not shown), but it is not limited to this.

The limit bolt 35 may be displaceably inserted into the toggle member 33 and may have a bolt head 351 facing the limit hole 311.

The elastic element 36 abuts between the toggle member 33 and the bolt head 351 of the limit bolt 35, and constantly generates a biasing force that causes the bolt head 351 to pass through the limit hole 311. When the bolt head 351 passes through the limit hole 311, the lower riser 31 may be limited by the limit bolt 35 and cannot rotate relative to the toggle member 33.

Figure 5:
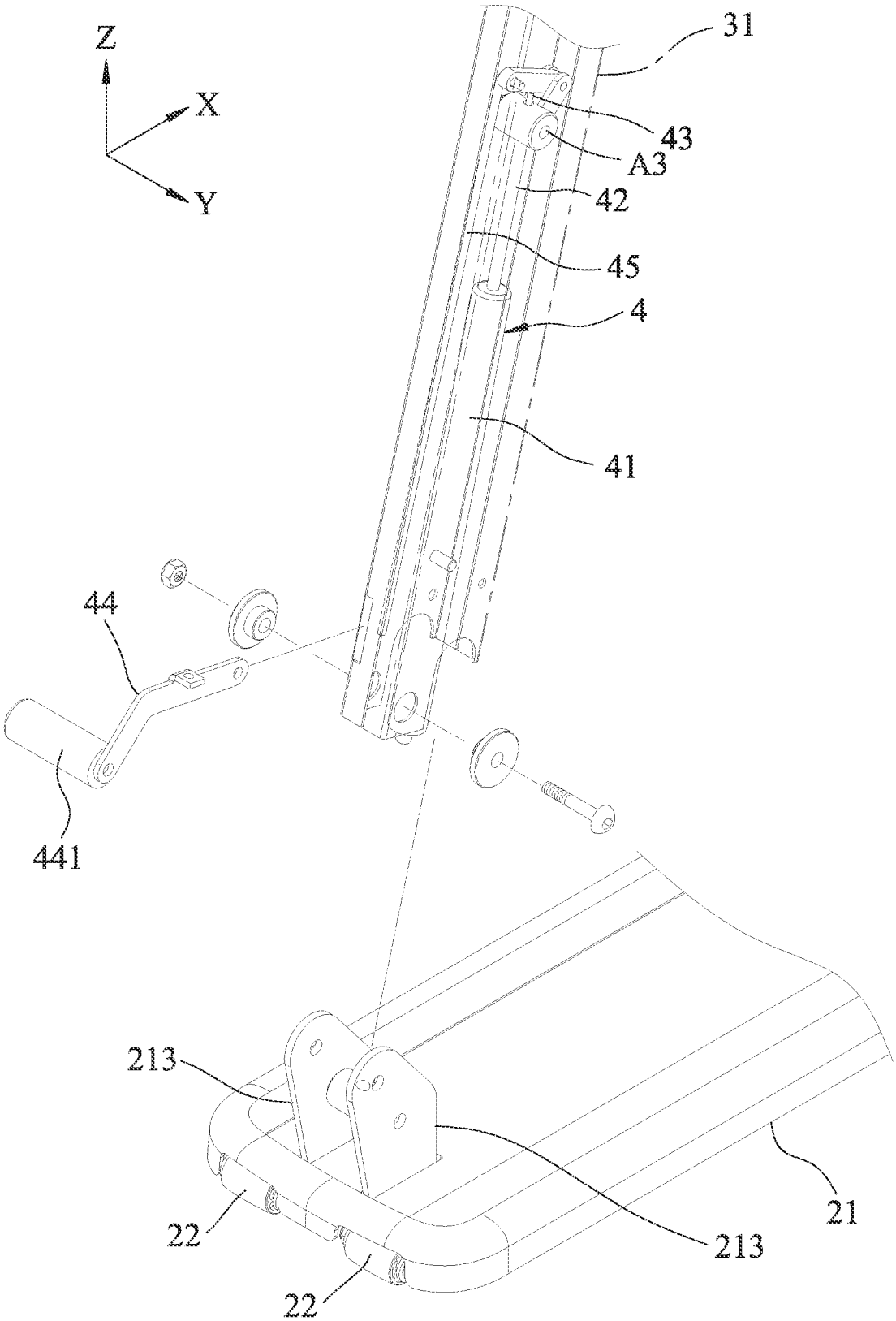
FIG. 5 is an incomplete three-dimensional exploded view illustrating a stand unit, a base unit, and a support unit in the present embodiment.
Figure 6:
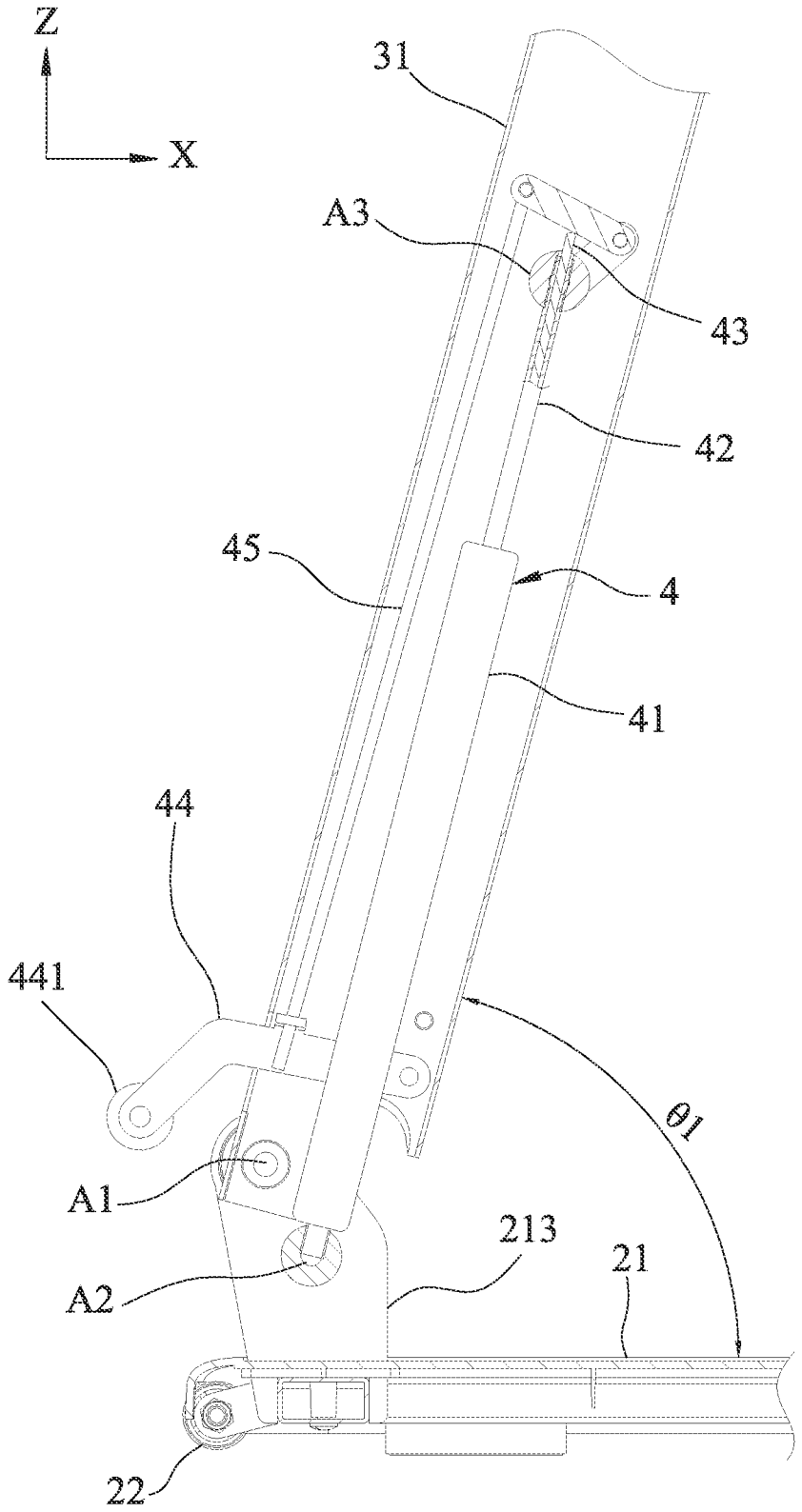
FIG. 6 is an incomplete cross-sectional view illustrating that a control member in the present embodiment is adjacent to the base unit and drives a valve stem through a link group.

Referring to FIGS. 5 and 6, the support unit 4 may be inserted in the lower riser 31 and may include a cylinder 41, a piston rod 42, a valve stem 43, a control member 44, and a link group 45.

The cylinder 41 may be pivotally connected to the connection lugs 213 with a second pivot point A2 as a rotation center.

The piston rod 42 may be pivotally connected to the lower riser 31 with a third pivot point A3, and may switch between a movable state and a positioning state. When in the movable state, it can telescopically move relative to the cylinder 41 and link with the lower riser 31 to rotate within the first angle range θ1; when in the positioning state, the piston rod 42 may be fixed with the cylinder 41, and may constantly generate a supporting force to maintain the lower riser 31 at a fixed angle.

The valve stem 43 may pass through the piston rod 42 and have a restoring force for determining whether the piston rod 42 is in the movable state or the positioning state.

In the present embodiment, the cylinder 41 and the piston rod 42 are generally commercially available locking cylinders. The cylinder 41 may be filled with hydraulic oil. The position of the piston rod 42 in the cylinder 41 will divide the cylinder 41 into upper and lower chambers. The movable state refers to that the valve port on the piston rod 42 is opened by the valve stem 43, so that the hydraulic oil can flow unimpeded in the upper and lower chambers. The positioning state refers to that the valve port on the piston rod 42 is closed by the valve stem 43, and the hydraulic oil cannot flow. This is the prior art, and those of ordinary skill in the art can deduce the details based on the above description, so no further description will be given.

The control member 44 may be pivotally connected to the lower riser 31 and adjacent to the base unit 2, and have a driving part 441 that is exposed and can be operated.

The link group 45 may be connected to the control member 44 and the valve stem 43, and may be driven by the control member 44 to drive the valve stem 43, thereby enabling the control member 44 to control the piston rod 42 to switch between the movable state and the positioning state.

Figure 2:
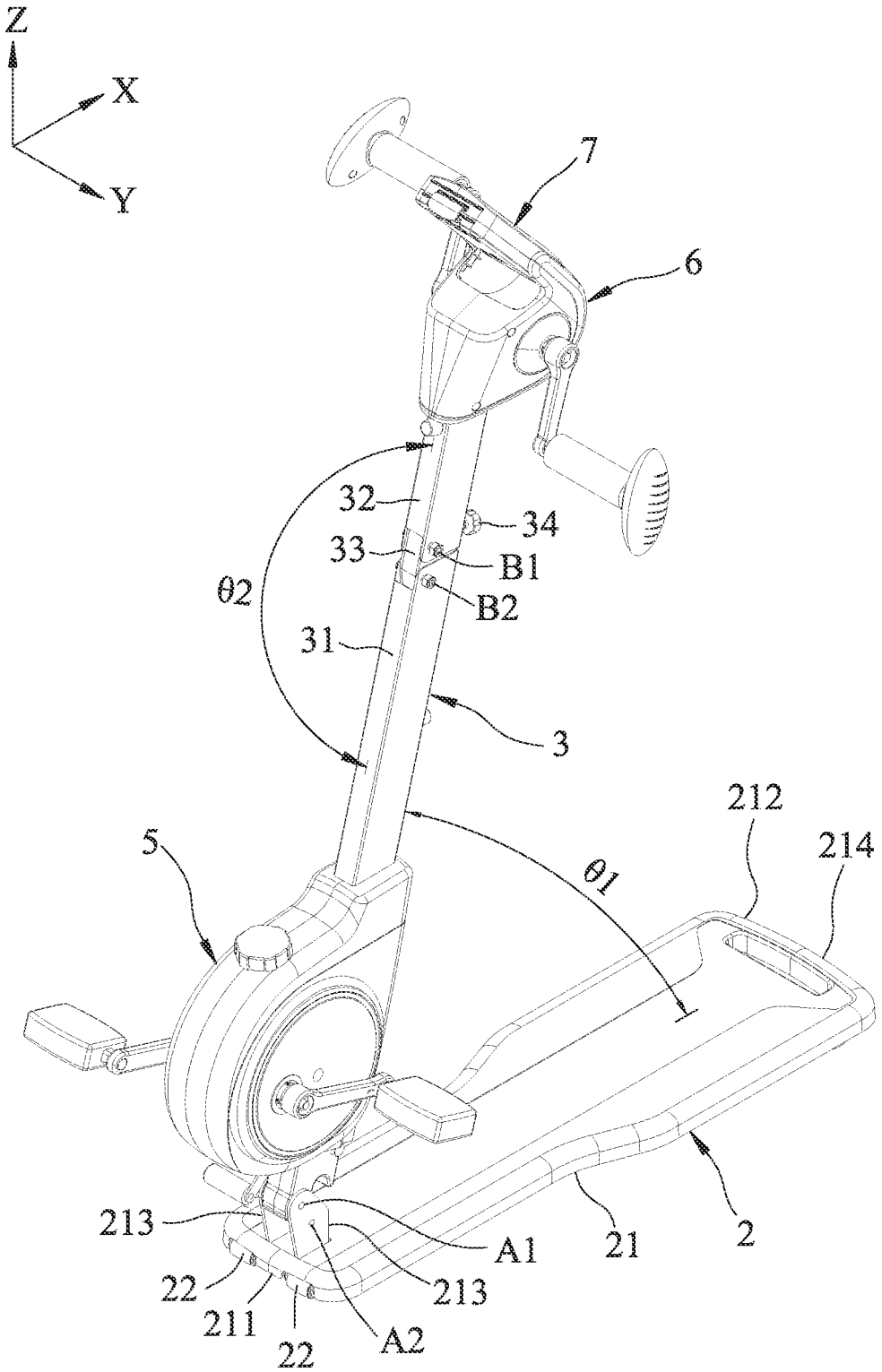
FIG. 2 is a perspective view illustrating an embodiment of the exercise bike capable of folding and changing at multiple angles according to the present disclosure.

Referring to FIG. 2, the first resistance unit 5 may be arranged on the lower riser 31 of the stand unit 3, and may be suitable for providing resistance to limbs, such as feet, when they are moving.

The second resistance unit 6 may be arranged at an end of the upper riser 32 away from the base unit 2 and may be suitable for providing resistance to limbs, such as hands, when they are moving.

In the present embodiment, the first resistance unit 5 and the second resistance unit 6 may be a device that uses magnetic force to generate resistance, or a device that uses plastic friction parameter resistance, and so on.

The panel 7 may be pivotally connected to the second resistance unit 6, and the pitch angle can be adjusted.

Referring to FIGS. 2, 5 and 6, when the angle between the stand unit 3 and the base 21 is to be adjusted, it is only necessary to step down on the driving part 441 of the control member 44 to drive the link group 45 to link with the valve stem 43 for a displacement, the piston rod 42 can be switched to the movable state. The piston rod 42 can expand and contract with respect to the cylinder 41, the cylinder 41 and the piston rod 42 can be rotated with the second pivot point A2 and the third pivot point A3, the stand unit 3 may be made to rotate within the first angle range θ1 with the first pivot point A1 as the center of rotation. After reaching a predetermined angle that meets the requirements, only by releasing the control member 44, the valve stem 43 can be restored to its original position by the restoring force of the valve stem 43, such that the piston rod 42 can be switched to the positioning state. Thereby, under a condition that the piston rod is fixed in position, the connection lugs 213, the lower riser 31, the cylinder 41, the piston rod 42 and the link group 45 can form a four-bar linkage mechanism, and they are mutually restricted, and the piston rod 42 may constantly generate a supporting force to maintain the lower riser 31 at a fixed angle.

Referring to FIGS. 2, 3 and 4, when the angle between the upper riser 32 and the lower riser 31 is to be adjusted, only the positioning bolt 34 needs to be pulled in the opposite direction to the toggle member 33 until the lock part 341 is separated from the corresponding positioning hole 331, the upper riser 32 can rotate relative to the lower riser 31 within the second angular range θ2 with the first elbow joint B1 as the center of rotation. After reaching a predetermined angle that meets the requirements, only the positioning bolt 34 needs to be released until the lock part 341 is inserted into the corresponding positioning hole 331, and the upper riser 32 can be positioned.

Figure 7:
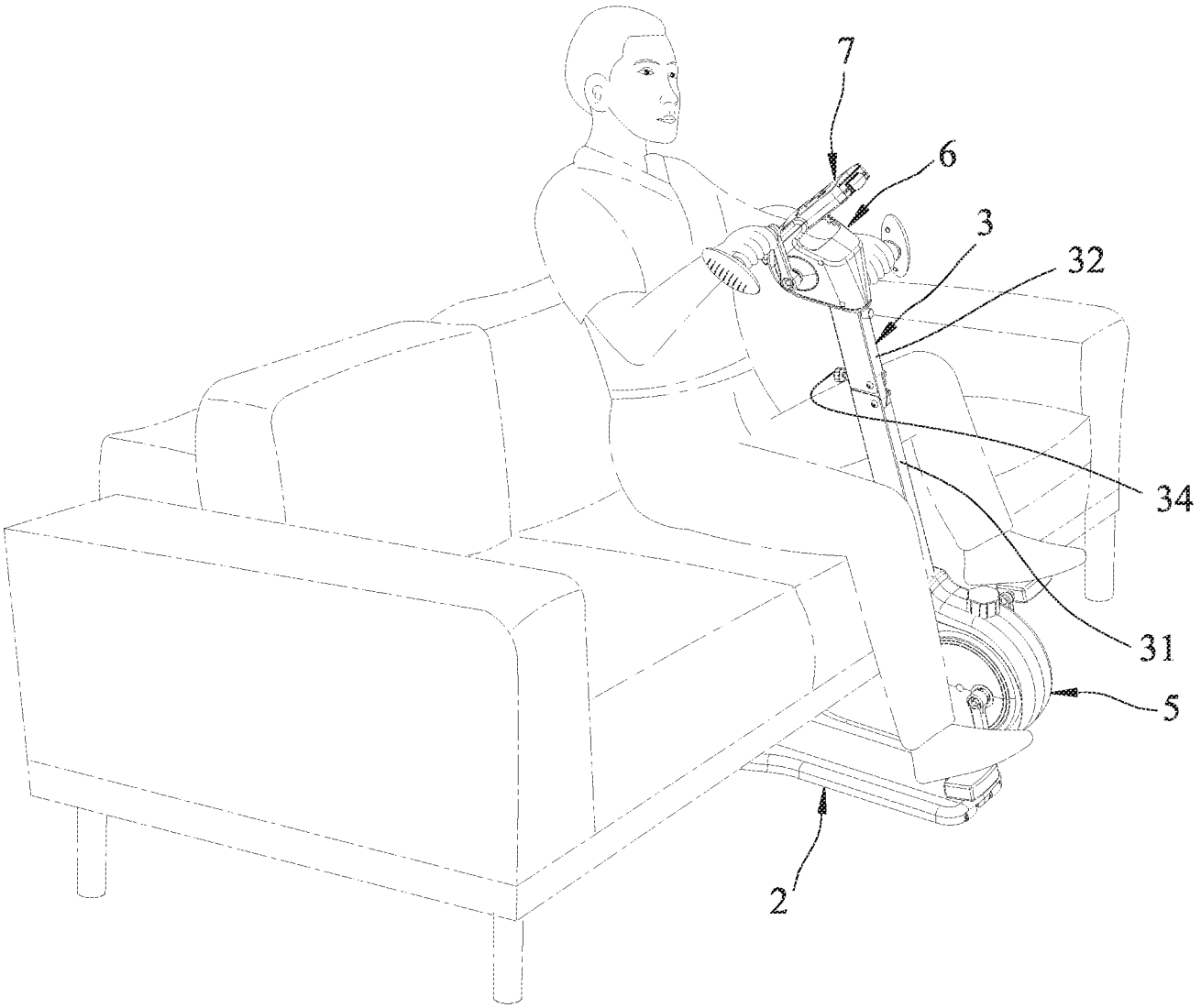
FIG. 7 is a three-dimensional schematic diagram of the present embodiment when in use.
Figure 8:
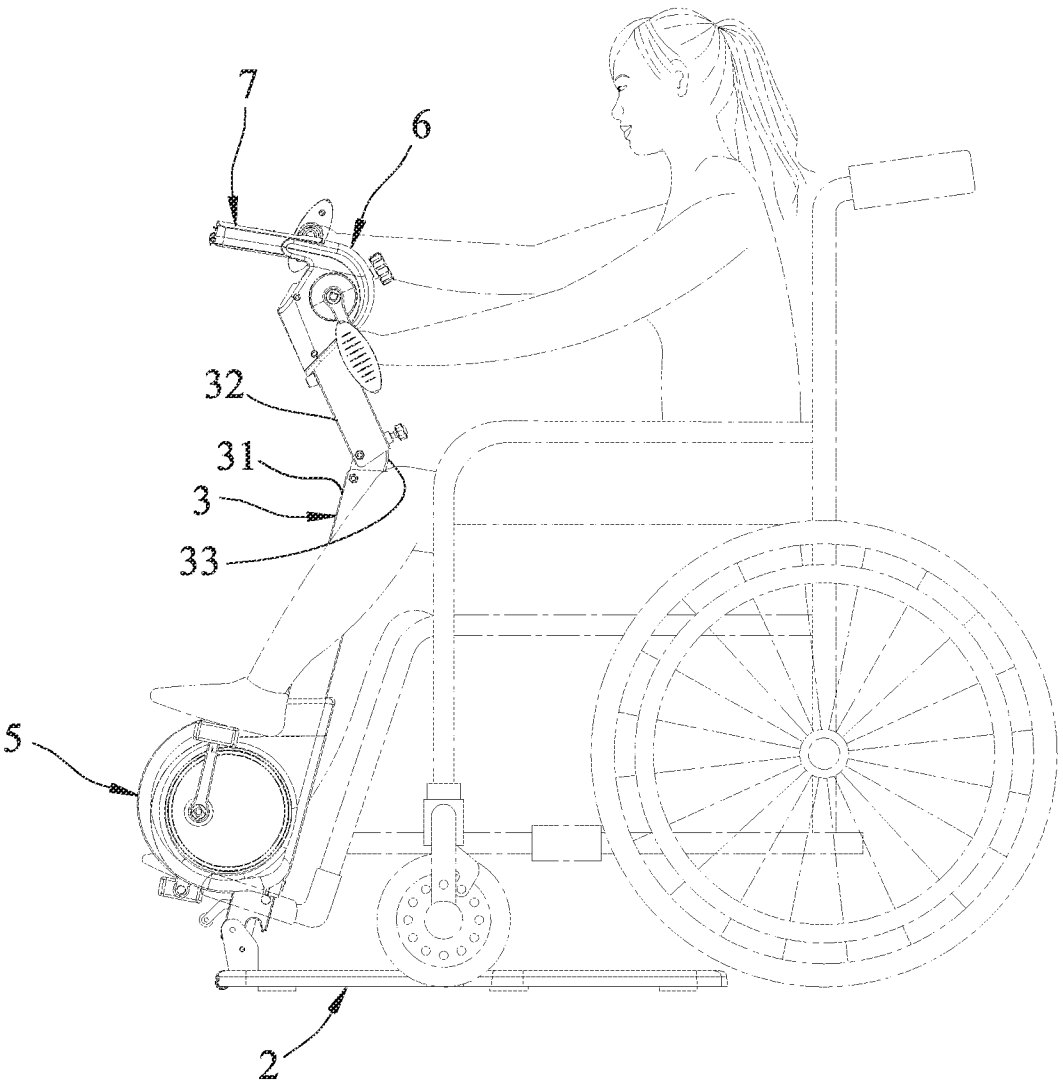
FIG. 8 is another three-dimensional schematic diagram of the present embodiment when in use.

Thereby, through the different angle changes of the upper riser 32 and the lower riser 31, a variety of usage patterns such as FIGS. 7 and 8 can be transformed, so that users of different shapes or different usage habits can make the hands, feet, and other limbs to move in a most suitable posture.

Figure 9:
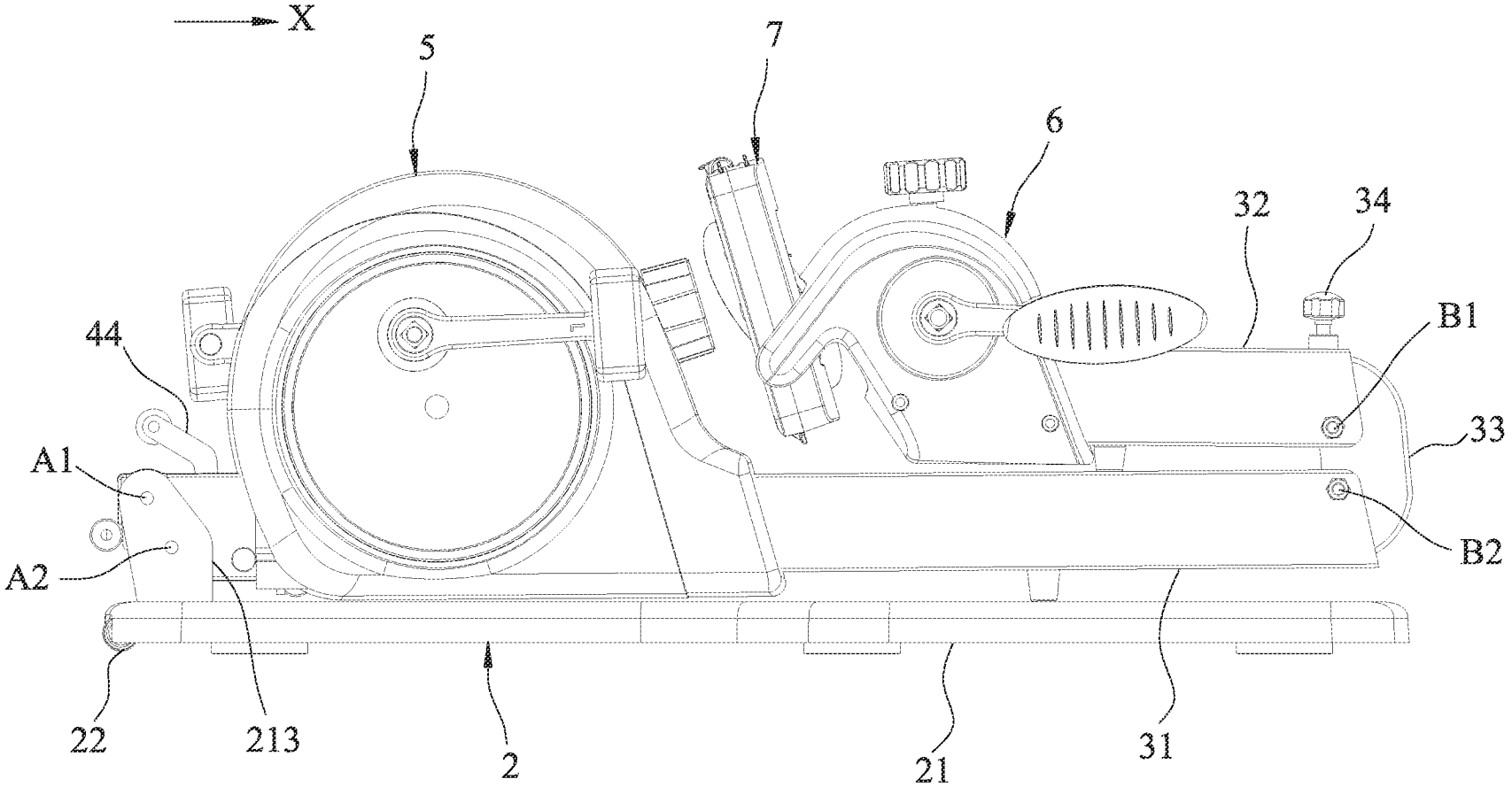
FIG. 9 is a perspective view of the present embodiment when folded.

Referring to FIGS. 3, 4 and 9, when the stand unit 3 rotates relative to the base unit 2 to an included angle close to 0 degrees with the base 21, and when the upper riser 32 rotates relative to the lower riser 31 to an included angle close to 0 degrees with the lower riser 31, the upper riser 32, the lower riser 31, and the base 21 of the base unit 2 overlap along the height direction Z from top to bottom. And since the length of the upper riser 32 along the height direction Z is less than the length of the lower riser 31 along the height direction Z, the first resistance unit 5, the panel 7 and the second resistance unit are spaced apart and arranged next to each other along the length direction X. Thereby, the space occupied by the whole may be reduced to a minimum, and the rollability of the two rollers 22 and the handle 214 on the base 21 can make the base unit 2 move with the front end 211 at a downward inclination angle and with the rear end 212 upward at an upward inclination angle, such that it is convenient for the user to tow the exercise bike of the present disclosure.

It is worth noting that the upper riser 32 is limited by the toggle member 33 and can only rotate about 90 degrees relative to the lower riser 31. At this time, if the upper riser 32 is continuously rotated relative to the lower riser 31, the upper riser 32 will link the toggle member 33 with the second elbow joint B2 as the center of rotation, and continue to rotate about 90 degrees relative to the lower riser 31. Then, the upper riser 32 can be rotated about 180 degrees relative to the lower riser 31 until the angle between the upper riser 32 and the lower riser 31 is close to 0 degrees, for an overlapping up and down.

Figure 10:
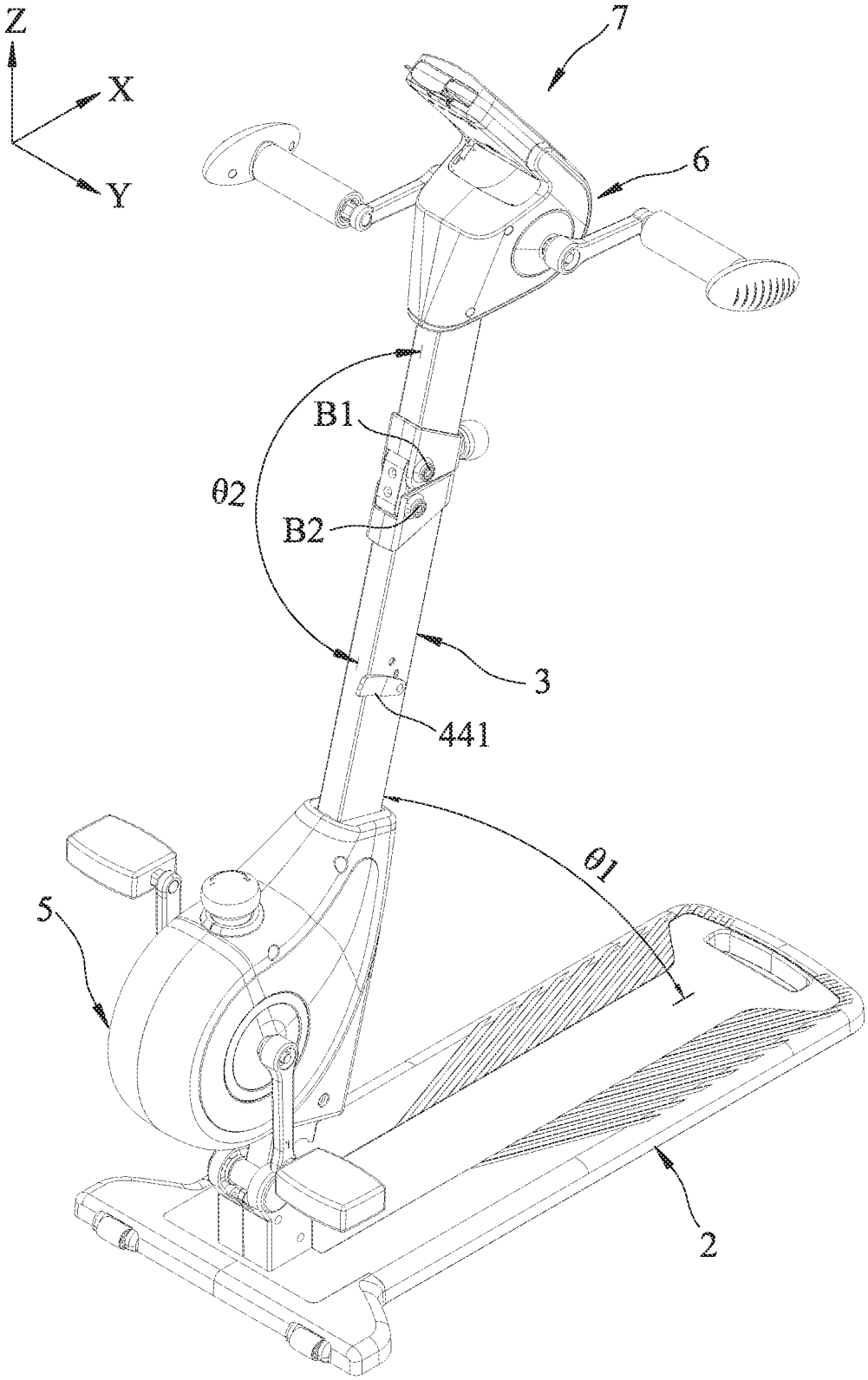
FIG. 10 is a perspective view similar to FIG. 2, but the control member is adjacent to an upper riser.
Figure 11:
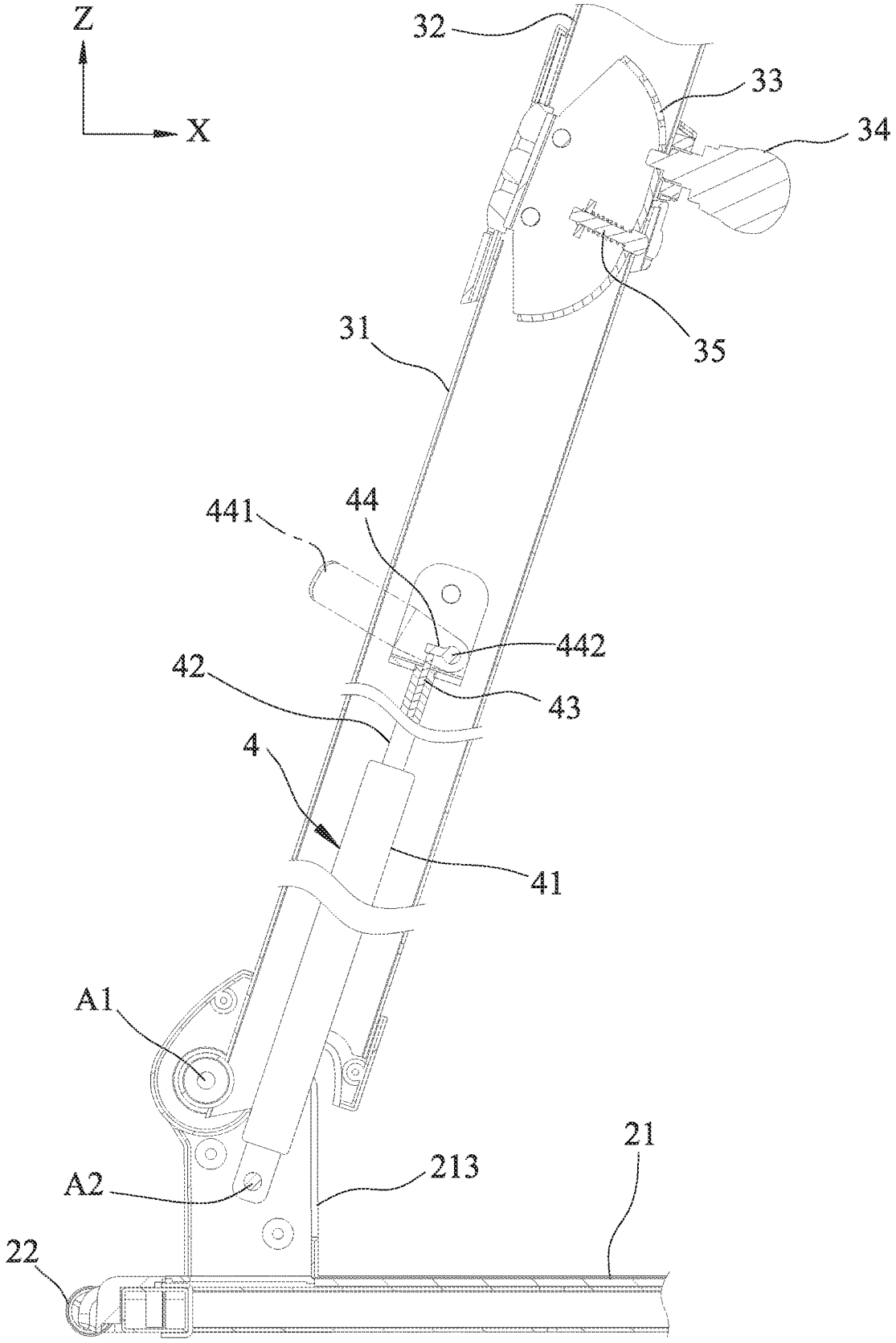
FIG. 11 is a cross-sectional view similar to FIG. 6, but the control member drives the valve stem with a link part.

It should be noted that the control member 44 is not limited to be arranged at a position adjacent to the base unit 2. In other variations of the present embodiment, it may also be provided adjacent to the upper riser 32 as shown in FIG. 10 and FIG. 11, and also has a link part 442 connected to the valve stem 43. Therefore, the link group 45 as shown in FIG. 6 can be omitted, and the driving part 441 of the control member 44 is directly rotated to drive the link part 442 to drive the valve stem 43 to control the piston rod 42 to switch between the movable state and the positioning state.

Based on the above description, the advantages of the foregoing embodiments can be summarized as follows:

1. The present disclosure can change the different angles of the upper riser 32 and the lower riser 31 to transform a variety of usage patterns, so that users of different body shapes or different usage habits can perform movement of the limbs, such as hands, feet and so on, in the most appropriate posture, and then improves the comfort of use in an ergonomic situation.

2. When the included angle between the stand unit 3 and the base 21 is equal to 0 degrees, and when the included angle between the upper riser 32 and the lower riser 31 is equal to 0 degrees, the base unit 2, the upper riser 32, and the lower riser 31 are overlapped up and down. The first resistance unit 5, the panel 7 and the second resistance unit 6 are spaced back and forth and arranged in close proximity, which can greatly reduce the overall length and height, and reduce the overall space occupation, effectively improves the space efficiency, and is easy to carry and store.

Although, in the above embodiment, the upper riser 32 is provided with the second resistance unit 6 providing resistance to the limbs (such as the upper limb) that are moving, and the lower riser 31 providing resistance to the limbs (such as the lower limb) that are moving, they are configured for the user to exercise comprehensively. However, in some other applications, the resistance unit can be one provided on the upper riser 32 or one provided on the lower riser 31, and the corresponding other riser can be additionally installed for supporting the support frame. For example, only the first resistance unit 5 is provided on the lower riser 31, and the second resistance unit 6 on the upper riser 32 is replaced with an armrest to realize a fitness machine for exercising lower limbs. Alternatively, only the second resistance unit 6 is provided on the upper riser 32, and the first resistance unit 5 on the lower riser 31 is omitted, such that the user steps on the base unit 2 to realize a fitness machine for exercising upper limbs. It can be expected that, since these exercise machines also use the folding mechanism of the upper riser 32 and the lower riser 31, the lower riser 31 and the base unit 2 in the above-mentioned preferred embodiment, they can also have the technical effects of the above-mentioned preferred embodiment, which can change multiple usage modes and can effectively improve the space efficiency.

Although the present disclosure is specifically shown and described in combination with the preferred embodiments, those skilled in the art should understand that all of various changes made to the present invention in form and details without departing from the spirit and scope of the present invention as defined by the appended claims fall within the protection scope of the present disclosure.

What is claimed is:

1. An exercise bike configured to fold and change at multiple angles, comprising:

a base unit extending along a length direction and having a front end and a rear end in opposite directions;

a stand unit comprising a lower riser pivotally connected to the front end of the base unit and an upper riser connected to the lower riser, wherein:

the lower riser is configured to rotate relative to the base unit within a first angle range, and the upper riser is configured to rotate relative to the lower riser within a second angle range;

a first resistance unit being provided on the lower riser of the stand unit and being configured to provide resistance to limbs when moving; and a second resistance unit being provided on the upper riser of the stand unit and being configured to provide resistance to limbs when moving, wherein:

the stand unit further comprises a toggle member inserted between the upper riser and the lower riser, the toggle member is pivotally connected to the upper riser with a first elbow joint and pivotally connected to the lower riser with a second elbow joint, the upper riser rotates relative to the lower riser with the first elbow joint as a center of rotation, and the upper riser rotates relative to the lower riser with the second elbow joint as a center of rotation with linking to the toggle member.

2. The exercise bike configured to fold and change at multiple angles according to claim 1, wherein:

the base unit comprises a base extending along the length direction and at least one roller, the base has the front end and the rear end, and the at least one roller is pivotally connected to a bottom of the front end of the base.

3. The exercise bike configured to fold and change at multiple angles according to claim 2, wherein the rear end of the base has a handle that is configured to be held.

4. The exercise bike configured to fold and change at multiple angles according to claim 1, further comprising a support unit, wherein:

the front end of the base unit has two connection lugs extending in a height direction and spaced apart in a width direction, the lower riser of the stand unit is pivotally connected to the two connection lugs with a first pivot point as a center of rotation, the support unit is inserted in the lower riser, the support unit comprises a cylinder pivotally connected to the two connection lugs with a second pivot point as a center of rotation and a piston rod pivotally connected to the lower riser with a third pivot point, the piston rod is configured to be telescopically displaced relative to the cylinder, the piston rod changes between a movable state and a positioning state, when the piston rod is in the movable state, the piston rod is configured to be telescopically displaced relative to the cylinder and linked with the lower riser to rotate within the first angle range, and when the piston rod is in the positioning state, the piston rod is fixed and maintains a constant position relative to the cylinder and the piston rod generates a supporting force to maintain the lower riser at a fixed angle.

5. The exercise bike configured to fold and change at multiple angles according to claim 4, wherein:

the support unit further comprises:

a valve stem that passes through the piston rod and is used to determine whether the piston rod changes between the movable state and the positioning state; and a control member pivotally connected to the lower riser and used to control the change of the piston rod between the movable state and the positioning state, wherein the control member has a driving part that is exposed and operable.

6. The exercise bike configured to fold and change at multiple angles according to claim 5, wherein:

the support unit further comprises a link group, the control member is adjacent to the base unit, and the link group is connected to the control member and to the valve stem.

7. The exercise bike configured to fold and change at multiple angles according to claim 5, wherein the control member is adjacent to the upper riser and has a link part connected to the valve stem.

8. The exercise bike configured to fold and change at multiple angles according to claim 1, wherein:

the stand unit further comprises a positioning bolt, the toggle member has a plurality of positioning holes equiangular distributed within a range of 90 degrees, the positioning bolt is displaceably provided on the upper riser relative to the toggle member, and the positioning bolt has a lock part configured to be detachably disposed in any of the plurality of positioning holes.

9. The exercise bike configured to fold and change at multiple angles according to claim 8, wherein:

the stand unit further comprises a limit bolt and an elastic element, the lower riser has a limit hole, the limit bolt is configured to be displaceably disposed in the toggle member and has a bolt head facing the limit hole, the elastic element abuts between the toggle member and the bolt head of the limit bolt, and the elastic element produces a constant biasing force that causes the lock part to penetrate into the limit hole.

10. The exercise bike configured to fold and change at multiple angles according to claim 1, further comprising a panel, wherein:

the second resistance unit is arranged at an end of the upper riser away from the base unit, and the panel is pivotally connected to the second resistance unit.

11. The exercise bike configured to fold and change at multiple angles according to claim 1, wherein:

a length of the upper riser in a height direction is less than a length of the lower riser in the height direction, when the stand unit rotates relative to the base unit to an included angle of 0 degrees with the base unit and when the upper riser rotates relative to the lower riser to an included angle of 0 degrees with the lower riser:

the base unit, the upper riser, and the lower riser are overlapped along the height direction, and the first resistance unit and the second resistance unit are spaced apart along the length direction.

12. The exercise bike configured to fold and change at multiple angles according to claim 1, wherein:

the first angle range is between 0 degrees and 150 degrees, and the second angle range is between 0 degrees and 270 degrees.

13. The exercise bike configured to fold and change at multiple angles according to claim 1, wherein:

the first angle range is between 0 degrees and 90 degrees, and the second angle range is between 0 degrees and 180 degrees.

14. An exercise bike configured to fold and change at multiple angles, comprising:

a base unit extending along a length direction and having a front end and a rear end in opposite directions;

a stand unit comprising a lower riser pivotally connected to the front end of the base unit and an upper riser connected to the lower riser, wherein:

the lower riser is configured to rotate relative to the base unit within a first angle range, and the upper riser is configured to rotate relative to the lower riser within a second angle range;

a first resistance unit being provided on the lower riser of the stand unit and being configured to provide resistance to limbs when moving;

a second resistance unit being provided on the upper riser of the stand unit and being configured to provide resistance to limbs when moving; and a support unit, wherein:

the front end of the base unit has two connection lugs extending in a height direction and spaced apart in a width direction, the lower riser of the stand unit is pivotally connected to the two connection lugs with a first pivot point as a center of rotation, the support unit is inserted in the lower riser, the support unit comprises a cylinder pivotally connected to the two connection lugs with a second pivot point as a center of rotation and a piston rod pivotally connected to the lower riser with a third pivot point, the piston rod is configured to be telescopically displaced relative to the cylinder, the piston rod changes between a movable state and a positioning state, when the piston rod is in the movable state, the piston rod is configured to be telescopically displaced relative to the cylinder and linked with the lower riser to rotate within the first angle range, and when the piston rod is in the positioning state, the piston rod is fixed and maintains a constant position relative to the cylinder and the piston rod generates a supporting force to maintain the lower riser at a fixed angle.

15. The exercise bike configured to fold and change at multiple angles according to claim 14, wherein:

the support unit further comprises:

a valve stem that passes through the piston rod and is used to determine whether the piston rod changes between the movable state and the positioning state; and a control member pivotally connected to the lower riser and used to control the change of the piston rod between the movable state and the positioning state, wherein the control member has a driving part that is exposed and operable.

16. The exercise bike configured to fold and change at multiple angles according to claim 15, wherein:

the support unit further comprises a link group, the control member is adjacent to the base unit, and the link group is connected to the control member and to the valve stem.

17. The exercise bike configured to fold and change at multiple angles according to claim 15, wherein the control member is adjacent to the upper riser and has a link part connected to the valve stem.

* * * * *